US006034045A

United States Patent [19]

Carr et al.

[11] Patent Number: 6,034,045

[45] Date of Patent: Mar. 7, 2000

[54] LIQUID LAUNDRY DETERGENT COMPOSITION CONTAINING A COMPLETELY OR PARTIALLY NEUTRALIZED CARBOXYLIC ACID-CONTAINING POLYMER

[75] Inventors: Charles D. Carr, Yardley, Pa.; John Ip, Princeton, N.J.; Anthony J. Falotico, Doylestown, Pa.

[73] Assignee: Church & Dwight Co., Inc., Princeton, N.J.

[21] Appl. No.: 08/805,772

[22] Filed: Feb. 25, 1997

[51] Int. Cl.[7] ..... C11D 3/37

[52] U.S. Cl. ..... 510/361; 510/321; 510/325; 510/434; 510/475

[58] Field of Search ..... 510/476, 321, 510/325, 361, 340, 434, 475

[56] References Cited

U.S. PATENT DOCUMENTS

| | | | |
|---|---|---|---|
| 3,308,067 | 3/1967 | Diehl | 252/161 |
| 4,483,843 | 11/1984 | Sonoda et al. | 423/573 |
| 4,617,139 | 10/1986 | Robb et al. | 252/135 |
| 4,689,167 | 8/1987 | Collins et al. | 252/95 |
| 4,849,125 | 7/1989 | Seiter et al. | 252/109 |
| 5,393,455 | 2/1995 | Poethkow et al. | 252/174.25 |
| 5,602,092 | 2/1997 | Repinec, Jr. et al. | 510/434 |
| 5,610,127 | 3/1997 | Erilli et al. | 510/235 |
| 5,750,485 | 5/1998 | Baillely et al. | 510/315 |

*Primary Examiner*—Yogendra Gupta
*Assistant Examiner*—Gregory Webb
*Attorney, Agent, or Firm*—Irving M. Fishman

[57] ABSTRACT

A liquid aqueous, laundry detergent composition which has a pH in the range of about 7.0 to about 12.2 and comprises at least one active surfactant; an at least partially neutralized polymer of an α,β-monoethylenically unsaturated carboxylic acid containing no more than nine carbon atoms which is either (1) a homopolymer of such an unsaturated carboxylic acid, (2) a copolymer of monomers consisting of at least two of such unsaturated carboxylic acids, or (3) a copolymer of monomers consisting of at least 50 mol % of at least one of such unsaturated carboxylic acids with at least one non-carboxylic acid α,β-monoethylenically unsaturated comonomer containing no more than nine carbon atoms, said polymer having a number average molecular weight of up to about 10,000 and being present in an amount equivalent to at least about 0.025 wt. % of the corresponding unneutralized polymer; and about 30 to about 95 wt. % of water, based on the total weight of the composition. Articles washed with the liquid detergent composition of this invention exhibit unexpectedly less soil redeposition than articles washed with a similar composition but which does not contain such at least partially neutralized polymer.

16 Claims, No Drawings

LIQUID LAUNDRY DETERGENT COMPOSITION CONTAINING A COMPLETELY OR PARTIALLY NEUTRALIZED CARBOXYLIC ACID-CONTAINING POLYMER

BACKGROUND OF THE INVENTION

1. Field of the Invention

This invention relates to improved aqueous liquid laundry detergent compositions.

2. Background Information Including Description of Related Art

Laundry detergent compositions are sold as either solid, i.e., powder or granular compositions, or liquid compositions. The advantages of liquid over solid compositions are that the caking tending to occur with solid compositions is avoided, the liquid composition is more easily dispersed in wash water, and a liquid is more easily measured and added to the washing machine without spillage than is a solid composition. However, a disadvantage in the use of many liquid detergent compositions as with solid compositions is the phenomenon of soil redeposition, i.e., the tendency of soil which is separated from the articles being washed by the detergency action of the composition, to redeposit on the washed articles causing them to appear dingy after several washings. Thus, any expedient which has the effect of reducing soil redeposition in liquid detergents is very desirable.

U.S. Pat. No. 4,521,332, issued Jun. 4, 1985 to Milora, discloses a highly alkaline aqueous cleaning dispersion useful for cleaning steel prior to various process operations, and comprising sodium hydroxide, a bulking agent such as sodium carbonate, and a polyacrylate acid dispersing agent.

U.S. Pat. No. 5,004,557, issued Apr. 2, 1991 to Nagarajan et al. teaches aqueous liquid laundry detergent compositions comprising a surfactant, a water-soluble sequester builder, and 0.1 to 2% of a homopolymer or copolymer of acrylic acid having a molecular weight in excess of 100,000, as an anti-redeposition and viscosity control agent.

U.S. Pat. No. 5,308,530, issued May 3, 1994 to Aronson et al., discloses a liquid detergent composition comprising calcium-stabilized enzymes and as a builder or anti-redeposition agent, a copolymer of an unsaturated carboxylic acid and a hydrophobic monomer prepared by solution polymerization.

U.S. Pat. No. 5,376,300, issued Dec. 27, 1994 to Bolkan et al., teaches a powdered laundry detergent comprising at least 70 wt. % of a carbonate salt builder, a small amount of a phosphorous-containing sequestering agent and about 0.1 to 2 wt. % of an at least partially neutralized polymer of an unsaturated carboxylic acid.

SUMMARY OF THE INVENTION

In accordance with this invention, a liquid aqueous detergent composition is provided which has a pH in the range of about 7.0 to about 12.2 and comprises at least one active surfactant; an at least partially neutralized polymer of an α,β-monoethylenically unsaturated carboxylic acid containing no more than nine carbon atoms which is either (1) a homopolymer of such an unsaturated carboxylic acid, (2) a copolymer of monomers consisting of at least two of such unsaturated carboxylic acids, or (3) a copolymer of monomers consisting of at least 50 mol. % of at least one of such unsaturated carboxylic acids and at least one non-carboxylic acid, α,β-monoethylenically unsaturated comonomer containing no more than nine carbon atoms, said polymer having a number average molecular weight of up to about 10,000 and being present in an amount of at least about 0.025 wt. % expressed as the weight of an equivalent amount of the corresponding unneutralized solid polymer; and a total water content of about 30 to about 95 wt. %. All of the foregoing weight percentages as well as those given hereinafter are based on the total weight of the complete detergent composition unless otherwise defined.

Articles washed with the liquid detergent composition of this invention exhibit unexpectedly less soil redeposition than articles washed with a similar composition but not containing the partially neutralized polymer.

DETAILED DESCRIPTION OF THE INVENTION

The active surfactant component present in the laundry detergent composition of this invention may consist of one or more of many suitable synthetic detergent active compounds which are commercially available and described in the literature, for example, in "Surface Active Agents and Detergents," Volumes 1 and 2 by Schwartz, Perry and Berch. Several detergents and active surfactants are also described in, for example, U.S. Pat. Nos. 3,957,695; 3,865,754; 3,932,316 and 4,009,114. In general, the detergent composition may include a synthetic anionic, nonionic, amphoteric or zwitterionic detergent active compound, or mixtures of two or more of such compounds.

Preferably, the laundry detergent compositions of this invention contain at least one anionic or nonionic surfactant, and, more preferably, a mixture of the two types of surfactant.

The contemplated water soluble anionic detergent surfactants are the alkali metal (such as sodium and potassium) salts of the higher linear alkylbenzenesulfonates (LAS) and the alkali metal salts of sulfated ethoxylated and unethoxylated fatty alcohols, and ethoxylated alkylphenols. The particular salt will be suitably selected depending upon the particular formulation and the proportions therein.

If a sodium alkylbenzenesulfonate surfactant (LAS), is used in the composition of the present invention, it preferably has a straight chain alkyl radical of average length of about 11 to 13 carbon atoms.

Specific sulfated surfactants which can be used in the compositions of the present invention include sulfated ethoxylated and unethoxylated fatty alcohols, preferably linear primary or secondary monohydric alcohols with $C_{10}$–$C_{18}$, preferably $C_{12}$–$C_{16}$, alkyl groups and, if ethoxylated, on average about 1–15, preferably 3–12 moles of ethylene oxide (EO) per mole of alcohol, and sulfated ethoxylated alkylphenols with $C_8$–$C_{16}$ alkyl groups, preferably $C_8$–$C_9$ alkyl groups, and on average from 4–12 moles of EO per mole of alkyl phenol.

The preferred class of anionic surfactants are the sulfated ethoxylated linear alcohols, such as the $C_{12}$–$C_{16}$ alcohols ethoxylated with an average of from about 1 to about 12 moles of ethylene oxide per mole of alcohol. A most preferred sulfated ethoxylated detergent is made by sulfating a $C_{12}$–$C_{15}$ alcohol ethoxylated with 3 moles of ethylene oxide per mole of alcohol.

Specific nonionic surfactants which can be used in the compositions of the present invention include ethoxylated fatty alcohols, preferably linear primary or secondary monohydric alcohols with $C_{10}$–$C_{18}$, preferably $C_{12}$–$C_{16}$, alkyl groups and on average about 1–15, preferably 3–12 moles of ethylene oxide (EO) per mole of alcohol, and ethoxylated alkylphenols with $C_8$–$C_{16}$ alkyl groups, preferably $C_8$–$C_9$ alkyl groups, and on average about 4–12 moles of EO per mole of alkyl phenol.

The preferred class of nonionic surfactants are the ethoxylated linear alcohols, such as the $C_{12}$–$C_{16}$ alcohols ethoxylated with an average of from about 1 to about 12 moles of ethylene oxide per mole of alcohol. A most preferred nonionic detergent is a $C_{12}$–$C_{15}$ alcohol ethoxylated with 7 moles of ethylene oxide per mole of alcohol.

Mixtures of the foregoing synthetic detergent type of surfactants, e.g., of anionic and nonionic, or of different specific anionic or nonionic surfactants, may be used to modify the detergency, sudsing characteristics, and other properties of the composition. For example, a mixture of different fatty alcohols of 12 to 15 carbon atoms may be ethoxylated, directly sulfated, or sulfated after ethoxylation, a fatty alcohol may be partially ethoxylated and sulfated, or an ethoxylated fatty acid may be partially sulfated to yield a mixture of different anionic and nonionic surfactants or different specific anionic or nonionic surfactants.

The total active surfactant in the composition may be in the range, for example, of about 5 to about 60 wt. % preferably about 15 to about 25 wt. %. If, as preferred, the active surfactant consists of a combination of anionic and nonionic surfactants, then the anionic surfactant is present in the range, for example, of about 1 to about 50 wt. %, preferably about 3 to about 7 wt. %, and the nonionic surfactant is present in the range, for example, of about 1 to about 50 wt. %, preferably about 12 to about 20 wt. %, based on the total weight of the composition.

The carboxylic acid-containing polymer contemplated in the liquid detergent composition of this invention is (before partial or complete neutralization) a homopolymer or copolymer (composed of two or more co-monomers) of an α,β-monoethylenically unsaturated acid monomer containing no more than nine, preferably no more than seven carbon atoms, such as acrylic acid, methacrylic acid, a diacid such as maleic acid, itaconic acid, fumaric acid, mesoconic acid, citraconic acid and the like, monoesters of diacids with alkanols, e.g., having 1–5 carbon atoms, and mixtures thereof. In addition to a homopolymer, the polymer may be, for example, a copolymer of monomers consisting of more than one of the foregoing unsaturated carboxylic acid monomers, e.g., acrylic acid and maleic acid, or a copolymer of monomers consisting of at least one of such unsaturated carboxylic acid monomers with at least one non-carboxylic acid, α,β-monoethylenically unsaturated monomer containing no more than nine, preferably no more than seven carbon atoms, which may be either non-polar such as styrene or an olefin, such as ethylene, propylene or butene-1, or which has a polar functional group such as vinyl acetate, vinyl chloride, vinyl alcohol, alkyl acrylates, vinyl pyridine, vinyl pyrrolidone, or an amide of one of the delineated unsaturated acid monomers, such as acrylamide or methacrylamide. Certain of the foregoing copolymers may be prepared by aftertreating a homopolymer or a different copolymer, e.g., copolymers of acrylic acid and acrylamide by partially hydrolyzing a polyacrylamide.

Copolymers of monomers consisting of at least one unsaturated carboxylic acid monomer with at least one non-carboxylic acid comonomer should contain at least about 50 mol % of the polymerized carboxylic acid monomer.

Particularly preferred carboxylic acid-containing polymers are homopolymers of one of the foregoing unsaturated carboxylic acids and copolymers of monomers consisting of more than one of such unsaturated carboxylic acids; more preferred are copolymers of acrylic acid and maleic acid; and most preferred are copolymers of about 50 to about 95 wt. % of acrylic acid and about 5 to about 50 wt. % of maleic acid based on the weight of the copolymer.

The carboxylic acid-containing polymer has a number average molecular weight of, for example, about 1000 to about 10,000, preferably about 2000 to about 5000. To ensure substantial water solubility, the polymer is completely or partially neutralized, e.g., with alkali metal ions, preferably sodium ions. The carboxylic acid-containing polymer may be partially or completely neutralized with base prior to being compounded with the other components of the detergent composition or it may be compounded as unneutralized polymer which is partially or completely neutralized in situ by basic compounds, generally sodium hydroxide and sodium silicate which have the effect of raising the pH of the composition to its desired level.

The carboxylic acid-containing polymer may be present in an amount, for example, of about 0.025 to about 1.9 wt. %, preferably about 0.05 to about 0.9 wt. %, calculated as solid unneutralized polymer and based on the total weight of the composition. When completely or partially neutralized with sodium hydroxide, the polymer salt is present in an amount somewhat greater than that of the corresponding unneutralized polymer because of the greater weight of the neutralizing sodium ions over the replaced hydrogen of the unneutralized polymer.

The liquid detergent compositions of this invention may also optionally contain sodium silicate which acts as a sequestrant builder effecting the sequestration of calcium and particularly magnesium ions in the wash water, and to provide some alkalinity for the purpose of keeping the anionic surfactant in neutral salt form and thus at maximum solubility. The sodium silicate may be present in the range, for example, of about 0.2 to about 3 wt. %, preferably about 1.0 to about 2.0 wt. % based on the total weight of the composition. Because of their limited solubility at the relatively high pH's of the detergent compositions of this invention, it is preferred that carbonate builders, including alkali metal carbonates, bicarbonates, and sesquicarbonates, not be present in the compositions. It is also preferred that the compositions not include any phosphorus-containing builders or sequestering agents such as orthophosphates, metaphosphates, pyrophosphates, polyphosphates or aminoethylenephosphonates, because they can contribute to undesirable eutrophication when present in waste streams.

The composition may also contain a chelating agent initially added to the water from which the liquid detergent composition is prepared to sequester metal ions which have an adverse effect on the detergent properties of the composition. Particularly suitable chelating agents are salts of ethylenediaminetetraacetic acid (EDTA), e.g., the tetra sodium salt ($Na_4EDTA$). If the $Na_4EDTA$ is used, it may be present in an amount, for example, of about 0.01 to about 2 wt. %, preferably about 0.02 to about 0.1 wt. %, based on the total weight of the composition.

The liquid detergent composition of this invention may, if desired, contain an enzymatic cleaning agent. It has been found, however, that compositions under the invention which do not contain such an enzymatic agent generally yield satisfactory cleaning performance with lower than expected soil redeposition, as shown in the examples described hereinafter. Thus, an enzymatic agent need not be present for most purposes.

In addition to the foregoing components, various conventional water-soluble adjuvants of liquid laundry detergents may also be present, such as, for example, optical brighteners, dyes and perfumes.

All of the contemplated components are dissolved or dispersed in water which is present in the final composition in an amount of, for example, about 30 to about 95 wt. %, preferably about 50 to about 85 wt. %, and more preferably about 70 to about 80 wt. %, based on the total weight of the composition. If the pH of the resulting composition is somewhat lower than the desired pH necessary to keep any anionic surfactant and sodium silicate present in dissolved and ungelled form, a strong base, preferably sodium hydroxide, is added to raise the pH to such desired level. The sodium hydroxide may be conveniently added as a 50 wt. % aqueous solution.

The following examples further illustrate the invention.

EXAMPLES 1 to 4 AND COMPARATIVE A AND B

These examples illustrate the unexpectedly low amount of soil redeposition obtained with the detergent compositions of this invention.

In Examples 1 and 3, the following components were compounded to formulate an aqueous liquid laundry detergent composition under this invention. All quantities are given in parts by weight: 3.18 parts of a sodium alkylbenzenesulfonate in which the alkyl radicals have an average length of about 11 to 13 carbon atoms (LAS, an anionic surfactant); 1.55 parts of the sodium salt of a sulfated $C_{12}$–$C_{15}$ alcohol ethoxylated with 3 moles of ethylene oxide per mole of alcohol (anionic surfactant) together with 1.03 parts of ethanol to solubilize the latter anionic surfactant for compounding; 14.2 parts of a $C_{12}$–$C_{15}$ alcohol ethoxylated with 7 moles of ethylene oxide per mole of alcohol (nonionic surfactant); 1.44 parts of sodium silicate; 0.04 part of $Na_4EDTA$ (chelating agent); 0.18 part of a stilbene fluorescent brightening agent; 0.29 part of a solution of a completely neutralized sodium salt of a copolymer of 90 wt. % acrylic acid and 10 wt. % of maleic acid having a number average molecular weight of about 3000, which solution contained 43.6 wt. % or about 0.13 part of solid completely neutralized polymer salt, equivalent to about 0.09 part of solid unneutralized polymer; 78.2 parts of water; and 0.15 part of sodium hydroxide which brings the pH of the solution to about 11.2.

In Examples 2 and 4 the same components were compounded as shown for Examples 1 and 3 except that 0.58 part rather than 0.29 part of the polymer salt solution was used, containing about 0.25 part of solid polymer salt equivalent to about 0.17 part of solid unneutralized polymer.

In Comparative Examples A and B, utilized as controls, the same components were compounded as shown for Examples 1 and 3, except that the sodium polymer salt was omitted.

The detergent compositions of Examples 1–4 and Comparative Examples A and B were tested for soil antiredeposition by washing at 95° F. and 150 ppm. (2/1 Ca/Mg ratio) of hardness, three replicate cotton (Examples 1 and 3 and Comparative Example A) and polycotton (a blend of 65 wt. % cotton and 35 wt. % polyester—Examples 2 and 4 and Comparative Example B) swatches with the compositions in the presence of background soil, and determining the reflectances before and after three cycles of washing, rinsing and drying. ASTM Test method D4008-89 was used, wherein oil stained polycotton pillowcases and separately added clay provided after each cycle as a source for soil are washed along with clean 100% cotton and polycotton swatches. The difference (Delta WIE) between the initial whiteness (initial WIE) of the fresh swatches and the final whiteness (final WIE) which in these examples is lower than the initial WIE, are determined after 3 wash/rinse/dry cycles using the measurements and calculations of ASTM Method E-313, and is a measure of the soil antiredeposition properties of the detergent composition used. Thus,lower Delta WIE's indicate less soil redeposition and better soil antiredeposition properties of the detergent, and higher Delta WIE's indicate greater soil redeposition and poorer soil antiredeposition properties of the detergent.

Table I shows the average values of Delta WIE obtained on 100% cotton with detergent compositions containing two different amounts of a carboxylic acid-containing polymer as described in Examples 1 and 2 and no polymer as a control, as described in Comparative Example A. The table shows for each example the weight percent of the completely neutralized polymer salt solution (Polym. Salt Soln.), the weight percent of the equivalent solid unneutralized polymer (Equiv. Unneut. Polym.) and the average Delta WIE.

TABLE I

| Example | Polym. Salt Soln., wt. % | Equiv. Unneut. Polym., wt. % | Delta WIE |
|---|---|---|---|
| A (control) | 0 | 0 | 49.85 |
| 1 | 0.29 | 0.09 | 12.47 |
| 2 | 0.58 | 0.17 | 9.71 |

The results of Table I show that after three wash cycles, an aqueous liquid laundry detergent containing a completely neutralized carboxylic acid-containing polymer equivalent to slightly less than 0.1 wt. % of corresponding unneutralized polymer has soil antiredeposition properties on 100% cotton much superior to the same detergent containing no polymer, while a similar detergent composition containing completely neutralized polymer salt equivalent to slightly less than 0.2 wt. % of unneutralized polymer has even better soil antiredeposition properties on 100% cotton than the composition containing neutralized polymer salt equivalent to slightly less than 0.1 wt. % of unneutralized polymer.

The information given in Table II is similar in type to that given in Table I except that Table II covers Examples 3 and 4 and Comparative B as a control, which deal with the soil antiredeposition properties of detergent compositions as they apply to polycotton rather than 100% cotton fabric.

TABLE II

| Example | Polym. Salt Soln., wt. % | Equiv. Unneut. Polym., wt. % | Delta WIE |
|---|---|---|---|
| B (control) | 0 | 0 | 28.70 |
| 3 | 0.29 | 0.09 | 6.22 |
| 4 | 0.58 | 0.17 | 6.17 |

The same general conclusions can be made regarding the results obtained with polycotton shown in Table II, as were made in connection with the results obtained with 100% cotton shown in Table I. It is noted, however, that in these examples, the difference between the soil redepositions obtained with the compsitions containing the two amounts of polymer were less with as shown in Table II than with 100% cotton as shown in Table I.

EXAMPLES 5 TO 8 AND COMPARATIVE EXAMPLE C

The procedure of Examples 1 and 3 and Comparative Example A was followed in the treatment of 100% cotton swatches, except that the detergent compositions contained varying amounts of from 25 to 1 wt. % of equivalent solid unneutralized polymer, and only two wash-rinse-dry cycles were completed, with reflectance and whiteness of the swatches determined and Delta WIE calculated after each of the first and second cycles. Table III shows for each example the amount of equivalent solid unneutralized polymer in the detergent composition and the average Delta WIE after each of the first and second cycles.

TABLE III

| Example | Equiv. Unneut. Polym., wt. % | Delta WIE 1st Cycle | Delta WIE 2nd Cycle |
|---|---|---|---|
| 5 | 1.00 | 4.05 | 5.78 |
| 6 | 0.75 | 5.45 | 7.13 |
| 7 | 0.50 | 4.61 | 6.29 |
| 8 | 0.25 | 4.31 | 6.52 |
| C (control) | 0 | 6.19 | 8.98 |

The results shown in Table III indicate that, with respect to the type of liquid laundry detergent tested, the addition of a small amount of a carboxylic acid-containing polymer under the invention effects a significant reduction of soil redeposition on 100% cotton fabric after one or two complete wash-rinse-dry cycles. Such results support the conclusion that the improvement will be apparent to consumers of the liquid laundry detergent composition.

EXAMPLES 9 TO 12 COMPARATIVE EXAMPLE D

The procedure of Examples 5 to 8 and Comparative Example C was followed except that polycotton swatches were used in place of 100% cotton. Results are shown in Table IV.

TABLE IV

| Example | Equiv. Unneut. Polym., wt. % | Delta WIE 1st Cycle | Delta WIE 2nd Cycle |
|---|---|---|---|
| 9 | 1.00 | 4.61 | 4.99 |
| 10 | 0.75 | 5.64 | 6.08 |
| 11 | 0.50 | 4.45 | 5.23 |
| 12 | 0.25 | 4.39 | 5.35 |
| D(control) | 0 | 12.28 | 17.71 |

The results shown in Table IV indicate that a conclusion similar to that stated with respect to results obtained with 100% cotton as shown in Table III can also be drawn with respect to polycotton, viz, that a significant reduction in soil redeposition is obtained when a small amount of a carboxylic acid-containing polymer under the invention is added to a standard liquid laundry detergent composition utilized in one or two wash/rinse/dry cycles.

EXAMPLES 13 AND 14 AND COMPARATIVE EXAMPLES E AND F

The procedures of Examples 1 and 3 utilizing a liquid detergent composition containing about 0.28 wt. % of sodium polymer salt solution, and of comparative Examples A–D utilizing the same detergent as Examples 1 and 3 except that the sodium polymer salt was omitted, were carried out on cotton (Example 13 and Comparative Example E) and polycotton (Example 14 and Comparative Example F) fabric swatches. The values of Delta WIE obtained after each of three wash/rinse/dry cycles for each example are shown in Table V.

TABLE V

| Example | Fabric | Polym Salt Soln, wt. % | Equiv Unneut. Polym, wt. % | Delta WIE Cycle 1 | Delta WIE Cycle 2 | Delta WIE Cycle 3 |
|---|---|---|---|---|---|---|
| E | Cotton | 0 | 0 | 5.61 | 8.28 | 10.38 |
| 13 | Cotton | 0.28 | 0.08 | 2.98 | 4.33 | 5.64 |
| F | Poly-cotton | 0 | 0 | 9.59 | 14.18 | 17.35 |
| 14 | Poly-cotton | 0.28 | 0.08 | 3.72 | 4.42 | 5.69 |

Consistent with the previous examples, the Delta WIE values show in Table V indicate that use of a liquid detergent composition containing a carboxylic acid-containing polymer under this invention results in a lower degree of soil redeposition on cotton and polycotton fabrics after three wash/rinse/dry cycles than use of the same detergent composition except for the lack of polymer. Furthermore, this effect is obtained after each wash/rinse/dry cycle, with the difference in soil redeposition becoming more pronounced with each additional cycle.

We claim:

1. A liquid, aqueous, laundry detergent composition which has a pH in the range of about 7.0 to about 12.2 and comprises at least one active surfactant; an at least partially neutralized copolymer of about 50 to about 95 wt. % of acrylic acid, and about 5 to 50 wt. % of maleic acid, said copolymer having a number average molecular weight of about 2000 to about 3000 and being present in an amount equivalent to about 0.025 to about 1 wt. % of said copolymer before neutralization; and about 30 to about 95 wt. % of water, based on the total weight of the composition, said composition being devoid of any carbonate builder, phosphorus-containing builder or phosphorus-containing sequestering agent.

2. The composition of claim 1 where the amount of said polymer before neutralization is about 0.05 to about 1 wt. %.

3. The composition of claim 1 comprising about 5 to about 60 wt. % of said surfactant.

4. The composition of claim 3 wherein said active surfactant comprises an anionic surfactant and a nonionic surfactant.

5. The composition of claim 4 wherein said anionic surfactant comprises an alkali metal salt of sulfated linear $C_{12}$–$C_{16}$ alcohols ethoxylated with an average of 1 to 12 moles of ethylene oxide per mole of alcohol and is present in an amount of about 1 to about 50 wt. %, and said nonionic surfactant comprises $C_{12}$–$C_{16}$ linear alcohols ethoxylated with an average of 1 to 12 moles of ethylene oxide per mole of alcohol and is present in an amount of about 1 to about 50 wt. %.

6. The composition of claim 5 wherein said amount of anionic surfactant is about 3 to about 7 wt. % and said amount of nonionic surfactant is about 12 to about 20 wt. %.

7. The composition of claim 1 also containing sodium silicate.

8. The composition of claim 1 also containing a chelating agent.

9. The composition of claim 8 wherein said chelating agent is a salt of ethylenediaminotetraacetic acid (EDTA).

10. The composition of claim 9 wherein said salt is the tetrasodium salt of EDTA.

11. The composition of claim 10 wherein said salt is present in an amount of about 0.01 to about 2 wt. %.

12. The composition of claim 1 which is non-enzymatic.

13. A process comprising washing a fabric in an aqueous wash liquor containing the composition of claim 1.

14. The composition of claim 1 wherein said unsaturated carboxylic acid monomer is at least one member selected from the group consisting of acrylic acid, methacrylic acid, the diacids maleic acid, itaconic acid, fumaric acid, mesoconic acid, and citraconic acid, and monoesters of said diacids with an alkanol.

15. The composition of claim 14 wherein said non-carboxylic unsaturated monomer is at least one member of the group consisting of styrene, olefins, vinyl acetate, vinyl chloride, vinyl alcohol, alkyl acrylates, vinyl pyridine, vinyl pyrrolidone and amides of said unsaturated carboxylic acid monomers.

16. A liquid, aqueous, laundry detergent composition which has a pH in the range of about 7.0 to about 12.2 and comprises at least one active surfactant; an at least partially neutralized copolymer of about 50 to about 95 wt. % of acrylic acid, and about 5 to 50 wt. % of maleic acid, said copolymer having a number average molecular weight of about 2000 to about 3000 and being present in an amount equivalent to about 0.025 to about 1 wt. % of said copolymer before neutralization; about 0.2 to about 3 wt. % of sodium silicate; and about 30 to about 95 wt. % of water, based on the total weight of the composition, said composition being devoid of any carbonate builder, phosphorus-containing builder or phosphorus-containing sequestering agent.

* * * * *